US005143320A

United States Patent [19]

Boyadjian

[11] Patent Number: 5,143,320

[45] Date of Patent: Sep. 1, 1992

[54] SPOILER TORQUE CONTROLLED SUPERSONIC MISSILE

[75] Inventor: Léon Boyadjian, Igny, France

[73] Assignee: Aerospatiale Societe Nationale Industrielle, Paris, France

[21] Appl. No.: 626,510

[22] Filed: Dec. 12, 1990

[30] Foreign Application Priority Data

Dec. 12, 1989 [FR] France ..... 89 16406

[51] Int. Cl.[5] ..... F42B 10/62

[52] U.S. Cl. ..... 244/3.21; 244/3.27

[58] Field of Search ..... 244/3.27, 3.26, 10, 244/21, 90 A, 110 D, 3.28, 3.29, 3.21, 3.22, 3.23, 3.24

[56] References Cited

U.S. PATENT DOCUMENTS

| | | | |
|---|---|---|---|
| 2,922,600 | 1/1960 | Craft | 244/3.28 |
| 3,136,250 | 6/1964 | Humphery | 244/3.27 |
| 3,188,958 | 6/1965 | Burke et al. | 244/3.27 |
| 3,305,194 | 2/1967 | Conard et al. | 244/3.21 |
| 3,588,004 | 6/1971 | Suter | 244/3.27 |
| 3,759,466 | 9/1973 | Evers-Euterneck | 244/3.21 |
| 4,327,884 | 5/1982 | Lawhorn | 244/3.21 |
| 4,497,460 | 2/1985 | Thorsted et al. | 244/3.3 |
| 4,699,333 | 10/1987 | Pinson | 244/3.21 |

FOREIGN PATENT DOCUMENTS

| | | | |
|---|---|---|---|
| 0013096 | 8/1980 | European Pat. Off. | 244/3.29 |
| 0264529 | 4/1988 | European Pat. Off. | 244/3.21 |
| 496912 | 11/1919 | France | 244/3.21 |
| 2342201 | 9/1977 | France . | |
| 1188651 | 4/1970 | United Kingdom | 244/3.27 |

*Primary Examiner*—Michael J. Carone
*Attorney, Agent, or Firm*—Browdy and Neimark

[57] ABSTRACT

A supersonic guided missile has a fuselage terminating at the front in a nose and at the rear in a base and is provided externally with fixed rear planes. At a longitudinal distance from the center of gravity is at least one spoiler mobile transversely between a configuration retracted inside the fuselage and an active configuration in which the spoiler projects laterally from the fuselage.

30 Claims, 7 Drawing Sheets

SPOILER TORQUE CONTROLLED SUPERSONIC MISSILE

BACKGROUND OF THE INVENTION

1. Field of the invention

The present invention concerns the guidance of supersonic missiles (submunitions) especially in the coast or deceleration phase. It is particularly, but not exclusively, directed to guided missiles propelled at high speeds (at least Mach 2 and in practise Mach 4 to 5) of the so-called high velocity missiles type operated at low altitude and designed to neutralize late detected airborne or terrestrial attackers such as, for example, tanks, combat helicopters or aircraft flying at high speed at low altitude and capable of sudden evasive maneuvers.

The invention is therefore directed in particular to a missile whose mission comprises a first boost or acceleration phase, during which the position of the center of gravity of the missile varies considerably in the longitudinal direction due to the consumption of propellants, followed by a second, coast or deceleration phase in which the position of the center of gravity remains fixed.

The invention is also directed to a ballistic missile (submunition or projectile) previously accelerated to the required speed by booster propulsion means which then separate. One finds again the aforementioned phase in which the position of the center of gravity is fixed.

The maneuvrability required of such missiles or projectiles is such that a low static margin is required, imposing an aerodynamic center which is relatively independent of the Mach number.

There are currently four control concepts:

1—aerodynamic control using tail fins. Said fins must have a very limited span to avoid any risk of flutter in the range of Mach numbers used (around Mach 6). In this case, long wings are necessary to obtain correct stability whatever the Mach number. This formula raises relatively serious problems due in particular to the actuators to be accommodated around the nozzle and the long wings to be carried by the propulsion unit;

2—aerodynamic control using nose-mounted foreplanes or "canard" fins. However, in this case conventional control methods are subject to known problems, namely the non-linearity of the aerodynamic characteristics as a function of the angle of incidence, loss of efficacy in angle of incidence and with high deflection, high hinge moments and virtual impossibility of control in roll;

3—the Thrust Vector Control System (TVCS), which is feasible during the booster phase, but another control formula is then needed (deceleration phase because there is no other propellant stage operating during the remainder of the mission;

4—finally, there is the concept using side jets: when they are nose-mounted they cause an area of increased pressure on the upstream side of the jets and an area of reduced pressure on the downstream side extending as far as the aft planes. Said jets create a favorable interaction aerodynamic moment which is added to the propulsive moment. However, this method of control provides inadequate maneuverability as it requires the mounting of a bulky and prohibitively heavy pneumatic or gas generator system in the nose of the missile.

An object of the invention is to alleviate the aforementioned disadvantages, especially in the guided deceleration phase, using the combination of one or more retractable spoilers and fixed planes (including any foreplanes), which results in a significant dynamic pressure effect due to the deployment of the spoiler. This advantageously makes the missile extremely maneuvrable at the cost of a minimal increase in weight.

In the context of the invention, the term "missile" is to be interpreted in a broad sense encompassing the concepts of missiles proper, submunitions and projectiles.

SUMMARY OF THE INVENTION

The present invention consists in a supersonic guided missile comprising a fuselage terminating at the front in a nose and at the rear in a base and provided externally with fixed aft planes and, at a longitudinal distance from its center of gravity, at least one spoiler mobile transversely between a configuration retracted inside the fuselage and an active deployed configuration in which said spoiler projects laterally from said fuselage.

A missile of this kind lends itself to pitch and/or yaw torque control which makes it possible in response to a command to deploy the spoiler to obtain a high load factor very fast for a supersonic missile flying at low altitude. The command action is advantageously progressive (even proportional) so as to generate the necessary but only just sufficient effect to control the supersonic missile.

In accordance with a preferred feature, the invention therefore proposes the addition to the fixed aft planes and any foreplanes of proportionally controlled front or rear spoilers.

Experiments have been conducted with three configurations in particular:

nose-mounted spoiler with foreplanes, aft spoiler with foreplanes, nose-mounted spoiler without foreplanes.

These three configurations offer the advantage over conventional configurations of having, for a given Mach number in response to a flight command, much higher load factors irrespective of the configuration chosen, although the configuration with the nose-mounted spoiler and foreplanes is by far and away the most advantageous from the point of view of increasing the efficiency and maneuvrability of the missile.

The enhanced efficiency due to the association of the nose-mounted or aft spoiler with the foreplanes has been proven. In the case of the nose-mounted spoiler, with or without foreplanes, the resultant transverse force is positive, favorable to the required maneuvrability and differs in this respect from the aft spoiler situation in which the force is negative and therefore contrary to the required maneuvrability.

Without foreplanes it is found that the resultant center of thrust is very slightly aft of said spoiler.

The addition of the foreplanes is highly beneficial: the resultant center of thrust is well forward of the spoiler which gives a much higher nose up moment. The effect of the aft spoiler is in the same order of magnitude in terms of the moment as that of the nose-mounted spoiler with foreplanes, but the load factor is lower because of the resultant loss of lift aft. The aft spoiler, on the other hand, had the advantage of reducing by more than half the additional aerodynamic drag in its active position.

In other words, according to preferred features of the invention:

—the spoiler remains at all times in a transverse plane when in and between its retracted and active configurations, —the fuselage further comprises foreplanes, —the spoiler is nose-mounted, —the spoiler is at a distance from the nose of the missile between 10% and 30% of the length of the fuselage, —if the fuselage has foreplanes, the aft surface of the spoiler is transversely aligned with the trailing edge of the foreplanes, —the spoiler is aft-mounted between two of the aft planes, —the spoiler is at a distance from the nose of the missile between 90% and 100% of the length of the fuselage, —if the fuselage has aft planes, the aft surface of the spoiler is transversely aligned with the trailing edge of the aft planes, —the nose of the fuselage is ogive-shape with an aspect ratio between two and four, —the spoiler is deployed radially to a distance less than 20% of the average transverse dimension of the fuselage, —the spoiler is deployed to approximately 10 to 20% of said average transverse dimension, —the spoiler is deployed to approximately 15% of said average transverse dimension, —the spoiler is deployed to a distance less than 20% of the length of the fuselage, —the spoiler is deployed to a distance equal to approximately 1 to 2% of the length of the fuselage, —the spoiler intersects the fuselage at an angle of approximately 90°, —the spoiler is actuated electrically, —the spoiler actuator comprises a motor with a shaft disposed transversely to the longitudinal axis of the missile, —the spoiler actuator comprises a motor with a shaft disposed parallel to the longitudinal axis of the missile, —the spoiler is actuated pneumatically, —the spoiler is actuated by a proportional control actuator, —the spoiler is mounted on a locally flat portion of the fuselage, —the fuselage has a substantially cylindrical, polygonal or elliptical cross-section.

Objects, characteristics and advantages of the invention will emerge from the following description given by way of non-limiting example only and with reference to the appended diagrammatic drawings.

DETAILED DESCRIPTION OF THE PREFERRED EMBODIMENTS

Figures 1, 2, 3, 4:
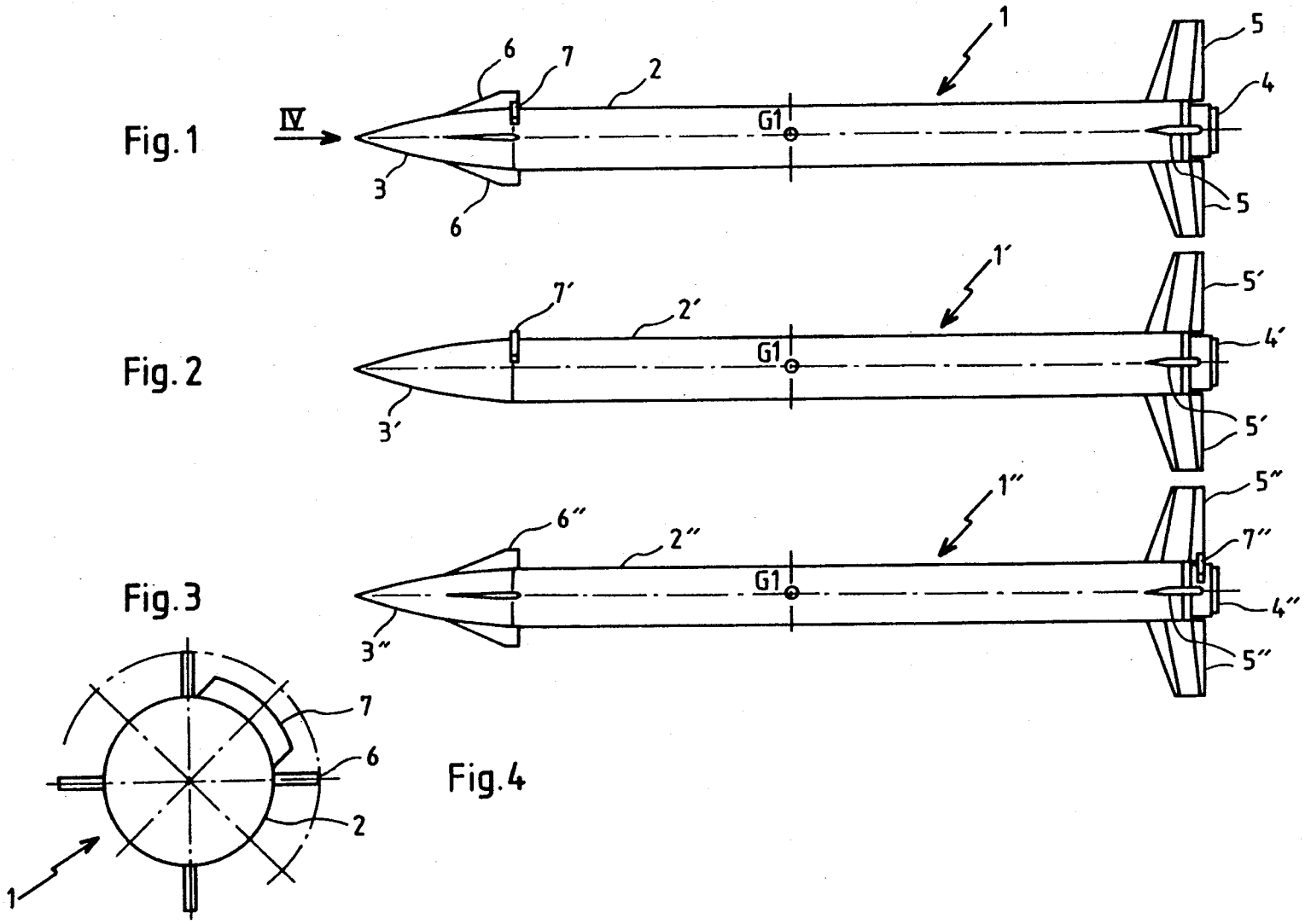
FIG. 1 is a schematic longitudinal view of a missile fitted with a first embodiment of the torque control system in accordance with the invention.
FIG. 2 is a schematic longitudinal view of a similar missile fitted with a second embodiment of the torque control system in accordance with the invention.
FIG. 3 is a schematic longitudinal view of a similar missile fitted with a third embodiment of the torque control system in accordance with the invention.
FIG. 4 is an end-on view of the missile from FIG. 1 as seen in the direction of the arrow IV.
Figures 5, 6, 7:
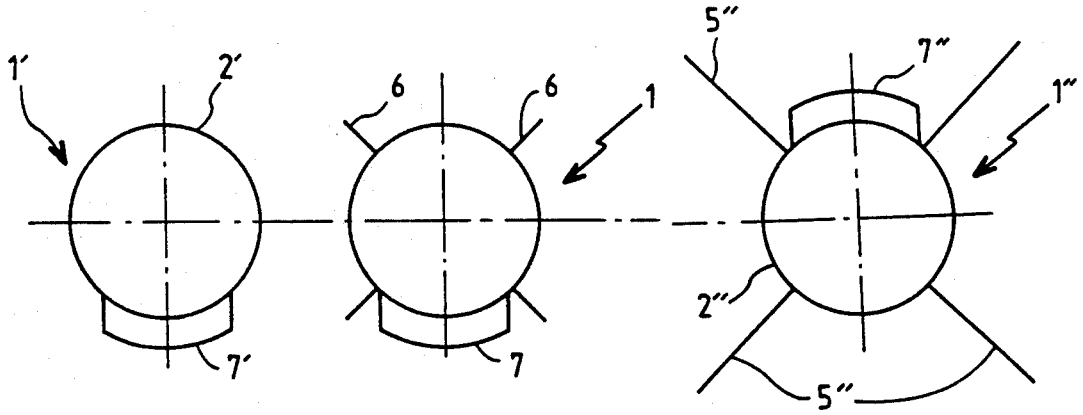
FIG. 5 is a view analogous to that of FIG. 4 but in a spatial configuration enabling pitch control of the missile.
FIGS. 6 and 7 are analogous views relating to FIGS. 2 and 3, respectively.

FIGS. 1, 4 and 5 show a missile 1 comprising a cylindrical fuselage 2 terminated at the front by an ogive-shape nose 3 and at the rear by a nozzle 4 and with four fixed tail fins or aft planes 5 of flat trapezoidal shape.

The missile 1 has four fixed nose-mounted foreplanes 6 of substantially flat trapezoidal shape. These foreplanes are partly on the ogive-shape nose 3 and partly on the cylindrical fuselage.

The internal structure of the missile is conventional with the exception of the torque control device described below and will not be described in more detail. Suffice to say that as this is a supersonic aerodynamic missile, the rear of the missile includes a propulsion unit of any suitable known type.

In an alternative embodiment, not shown, the missile is a ballistic missile and separable preliminary acceleration (booster) means are provided.

Between at least two of the foreplanes 6 is a transversely mobile spoiler 7 adapted to be retracted within the contour of the missile (and the nose) or to be deployed. In this embodiment there is a single spoiler. Its aft surface is longitudinally aligned with the trailing edge of the foreplanes 6. In this embodiment the spoiler is at all times in a transverse plane within which it is retracted or deployed.

FIGS. 2 and 6 show a missile 1' similar to the missile 1 (using the same reference numbers "primed"), except that it has no foreplanes.

FIGS. 3 and 7 show a missile 1" similar to the missile 1 (using the same reference numbers "double-primed"), except that the spoiler 7" is mounted aft near the nozzle 4" between two aft planes 5".

In FIG. 7 the aft spoiler 7" is shown on top of the missile 1" whereas in FIGS. 5 and 6 the nose-mounted spoilers 7 and 7, are shown underneath the missile 1 and 1'. This difference in location is explained by the fact that the required torque is a nose up torque.

Figure 8:
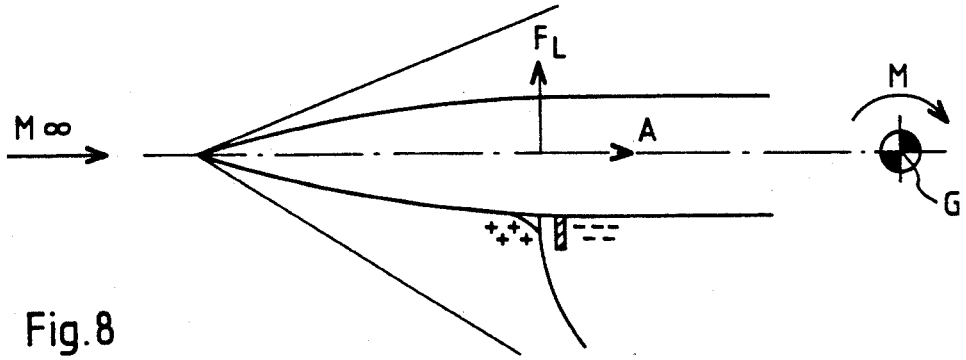
FIG. 8 is a diagram showing the forces and the moment applied due to the deployment of a spoiler.

FIG. 8 shows the forces which are produced on deploying the spoiler 7 or 7': it shows an axial braking component A and a transverse component $F_L$ which, relative to the center of gravity, is equivalent to a torque M tending to raise the nose 3 of the missile, $M_\infty$ representing the infinite Mach number ahead of the missile.

Figure 9:
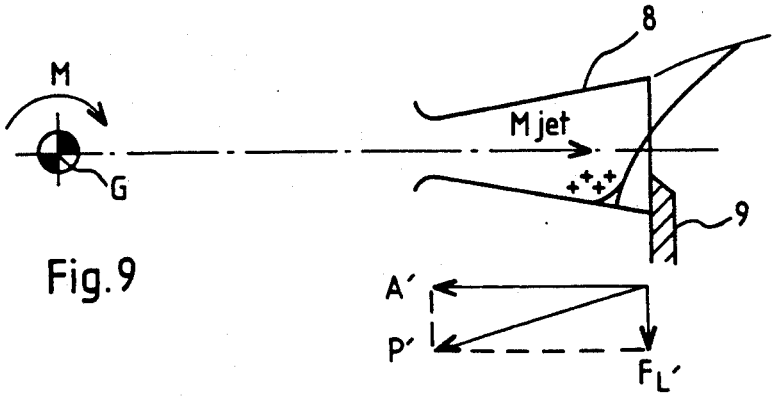
FIG. 9 is the equivalent diagram obtained with a conventional jet interceptor.

By analogy, FIG. 9 shows (for the third of the four control concepts explained above, that is to say for an aerodynamic missile) the forces produced by a jet vane 9 in the missile thrust nozzle adapted to intercept from below the thrust jets from the nozzle 8: the diagram shows an axial braking component A' directed forward and a transverse component $F_L$, directed downwards, the resultant P' of which is in the opposite direction to the FIG. 8 situation; however, relative to the center of gravity, this is equivalent to a torque in the same direction as in FIG. 8, $M_{jet}$ representing the Mach number at the jet outlet.

Comparing FIGS. 8 and 9 shows that the invention allows control of the missile, whether it is aerodynamic or ballistic, by sampling the external dynamic pressure in flight. It can also be seen that the pitch/yaw movement in the case of the nose-mounted spoiler is obtained by generating a force $F_L$ which operates in the direction of the required maneuver while in the case of the jet vane (and this is equally valid for an aft spoiler) the force is in the opposite direction. In the former case the load factor actually obtained (or commanded) is the sum of the aerodynamic load factor of the missile (given its instantaneous angle of incidence) and the load factor induced by the spoiler; in the second case the load factor actually obtained is equivalent to the aerodynamic load factor of the missile less the load factor induced by the spoiler. This explains why, from this point of view, nose-mounted spoilers are preferable.

The aerodynamic characteristics of the missiles 1, 1' and 1" were determined by wind tunnel tests for Mach numbers between 1.6 and 4.34 using scale models as shown in FIGS. 1 through 3 with a diameter (caliber) of 41.4 mm and a length of 585.6 mm (that is an aspect ratio —length/diameter ratio—of 14.14) and an ogive with a circular meridian and an aspect ratio of 2.5.

The cylindrical fuselage was fitted with foru aft planes at the nozzle with a span of 142.6 mm and an apex 533.6 mm from the tip of the nose.

Two of the three models were fitted with four foreplanes with the apex 60 mm from the tip of the nose and a span of 66.4 mm; the rake angle of the foreplane leading edge was 70° and the root chord was 50 mm.

The height of the deployed spoiler was 6.2 mm and its width 26 mm so that it could fit between the foreplanes or aft planes.

The circular arc shaped spoiler was:

either nose-mounted at a distance of 103.5 mm from the tip of the nose (FIG. 1 and 2 examples), aft-mounted at a distance of 571.6 mm from the tip of the nose (FIG. 3 example).

In other words, the nose-mounted spoiler was 2.5 calibers from the tip of the nose whereas the aft-mounted spoiler was 13.8 calibers from the tip of the nose, the spoilers projecting approximately 1.5 calibers (approximately 1% of the length of the fuselage).

Figure 11:
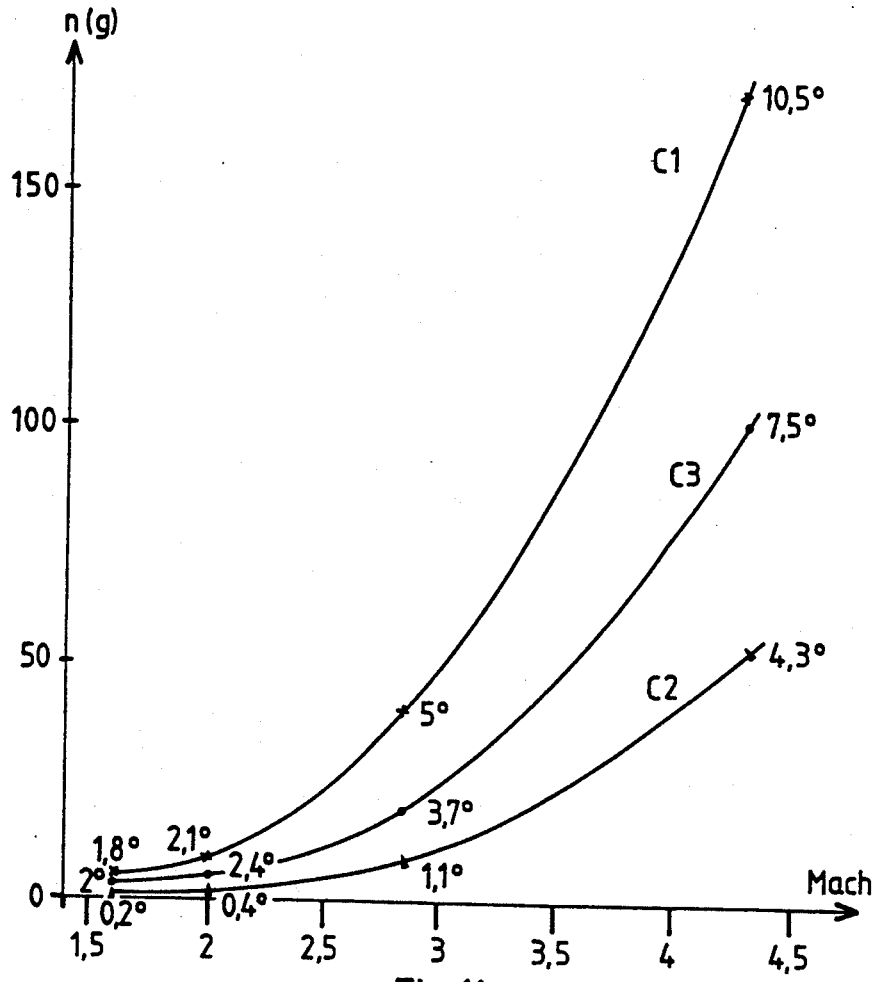
FIG. 11 is a graph showing the correlation between the load factor and the Mach number in the three configurations of FIGS. 1 through 3.
Figure 10:
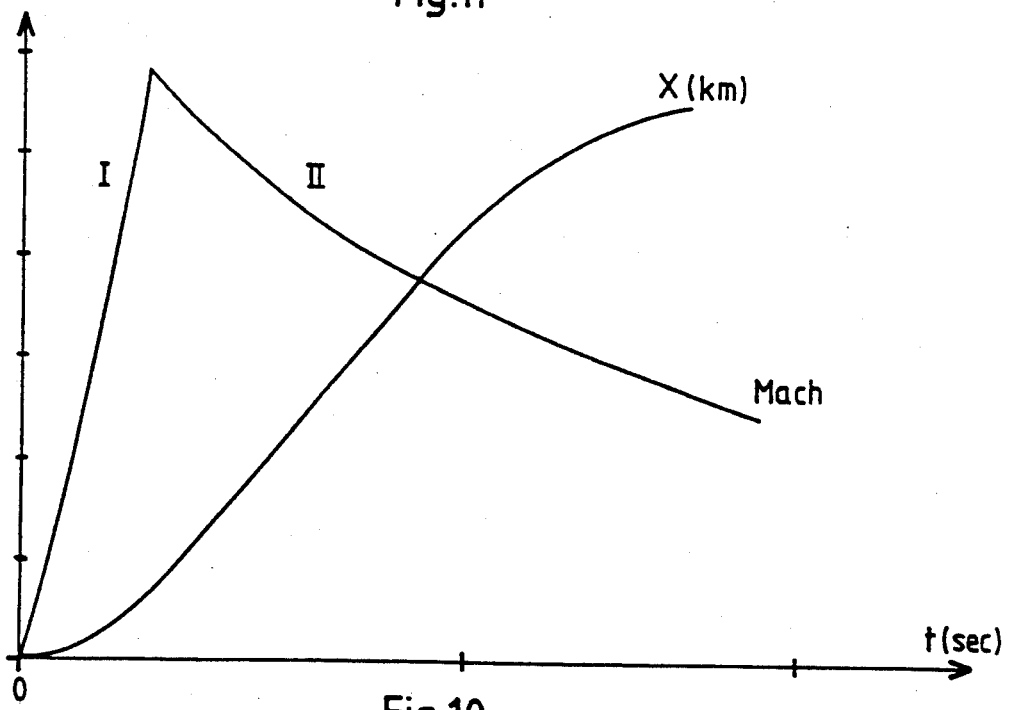
FIG. 10 is a graph showing as a function of time the Mach number M and the distance X travelled by the missile.

The aerodynamic characteristics obtained in this way are shown in the FIG. 10 and 11 graphs.

FIG. 10 shows a cusped velocity curve with an aerodynamic phase I and a ballistic phase II and the distance increasing continuously: the maximum Mach number was 6.

FIG. 11 shows three curves C1, C2 and C3 for the FIG. 1, 2 and 3 configurations, respectively. They show the correlation between the load factor m and the Mach number M. The vertical scale is graduated in gravities (g) and the numerical values adjacent the various points on the curve correspond to the angle $\alpha_{eq}$ representing the equilibrium angle of incidence of the missile relative to its instantaneous speed vector with $n(g)=f(M, \alpha_{eq})$ where f is an experimentally defined correlation function.

Various embodiments of the actuators for the spoiler 7, 7' or 7" are feasible, and the examples given hereinafter are not limiting on the invention.

Firstly, they may be electrical actuators.

The requirements of the specified missile are as follows with the notation:

| | |
|---|---|
| $Cm$ | denotes the torque produced by the spoiler relative to the center of gravity, |
| $\frac{dCm}{dt}$ | denotes the speed of the spoiler, |
| $\frac{d^2Cm}{dt^2}$ | denotes the acceleration. |

For example, $$Cm = 10^4 \text{ mN}$$
$$\frac{dCm}{dt} = 10^6 \text{ mN/s}$$
$$\frac{d^2Cm}{dt^2} = 10^8 \text{ mN/s2}$$

transposed to the full scale missile allowing for the required travel (approximately 26 mm); the configuration described is that of the nose-mounted spoiler as shown in FIG. 1 or 2.

The lever arm of the spoiler relative to the center of gravity of the missile is in the order of 1 m (neglecting forces tending to displace the spoiler outwardly in the case of a missile rotating on its axis):

the mass of the spoiler is estimated at 0.2 kg, its saturation acceleration is 250 m/s$^2$, its saturation speed is 2.5 m/s; the response time (ratio of the travel to the spoiler saturation speed) is therefore in the order of 10 ms, the motor force exerted on the spoiler is in the order of 500 N, the peak power to be applied to the spoiler is in the order of 1 400 W.

Figure 12:
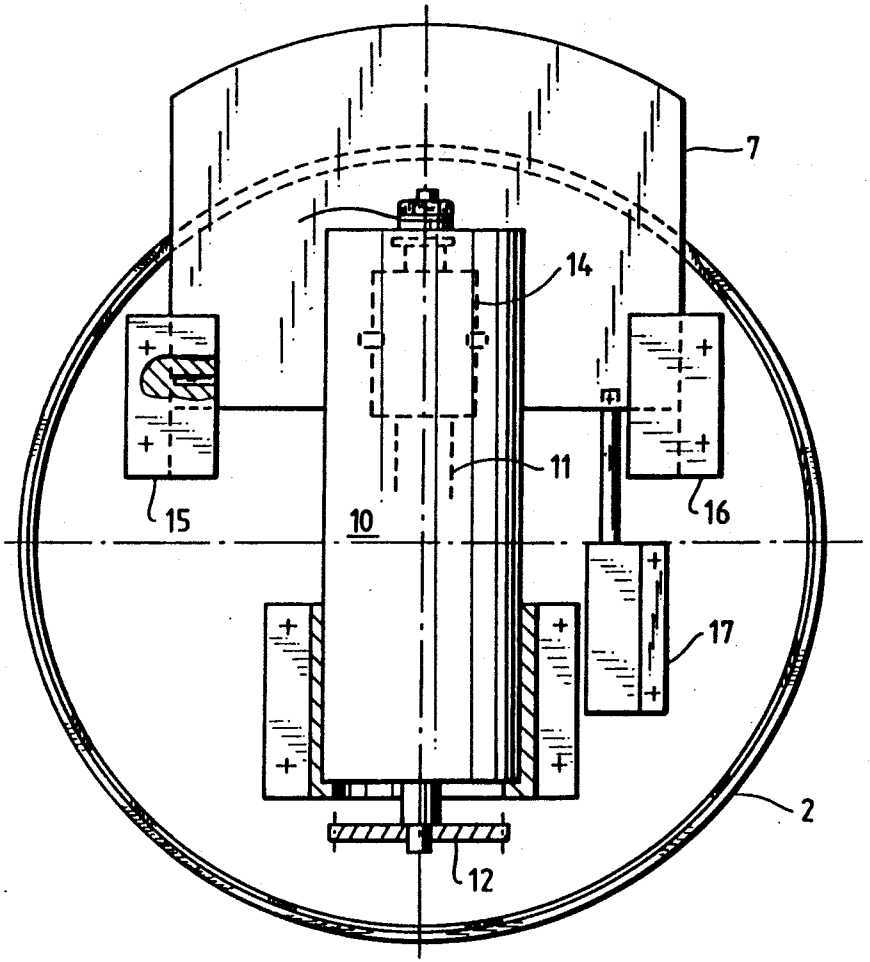
FIG. 12 is a view in transverse cross-section of a missile fitted with a first embodiment of torque control device.
Figure 13:
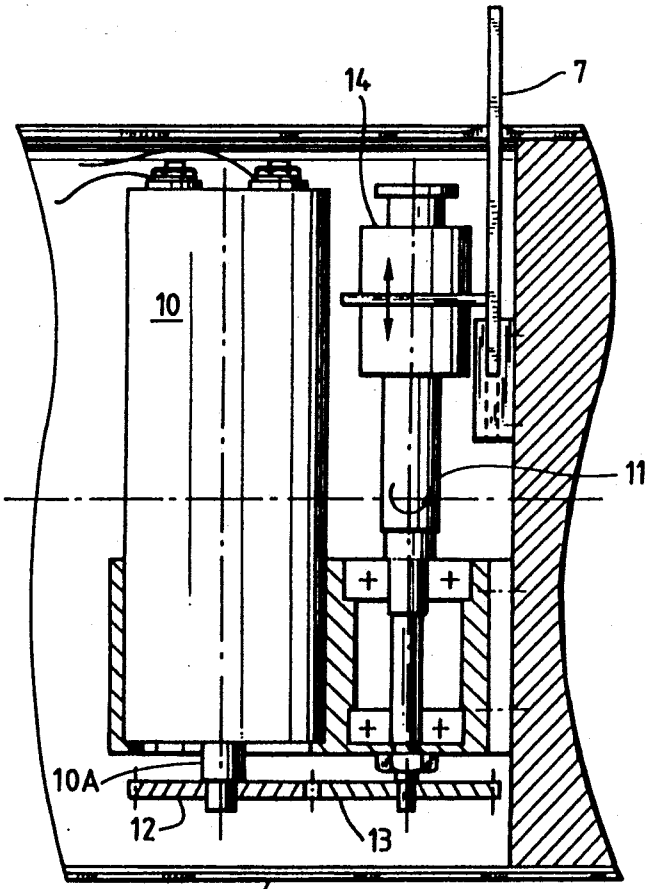
FIG. 13 is a partial view of it in longitudinal axial cross-section.
Figure 14:
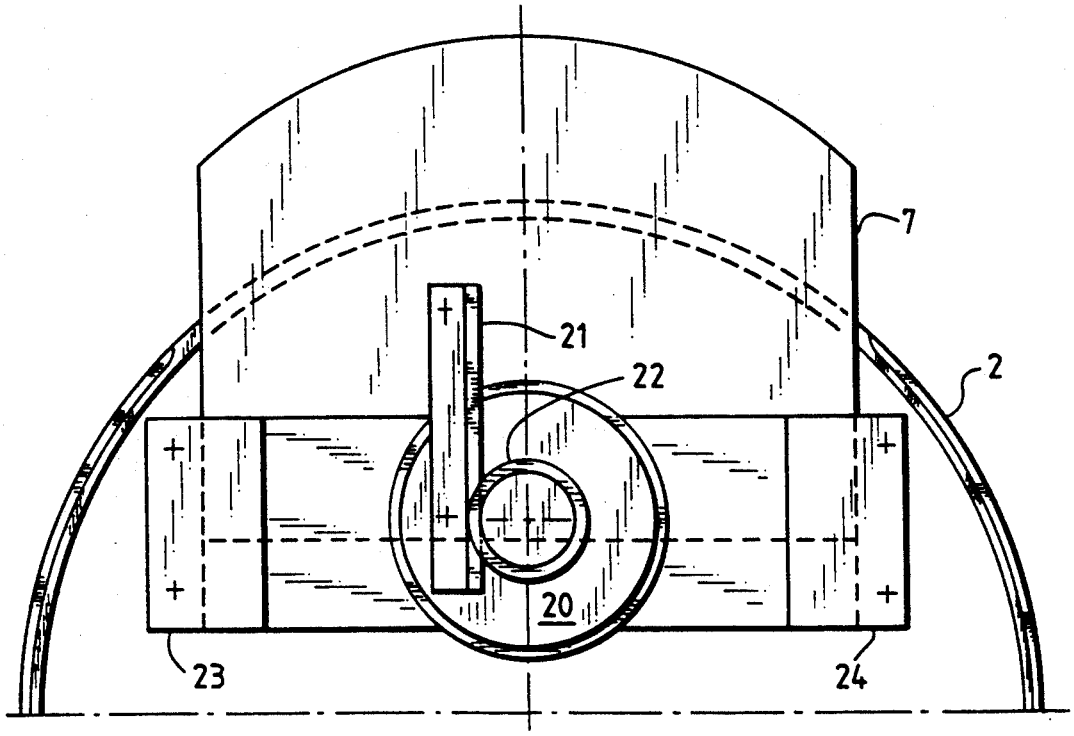
FIGS. 14 and 15 are views analogous to FIGS. 12 and 13 for a second embodiment of torque control device.
Figure 15:
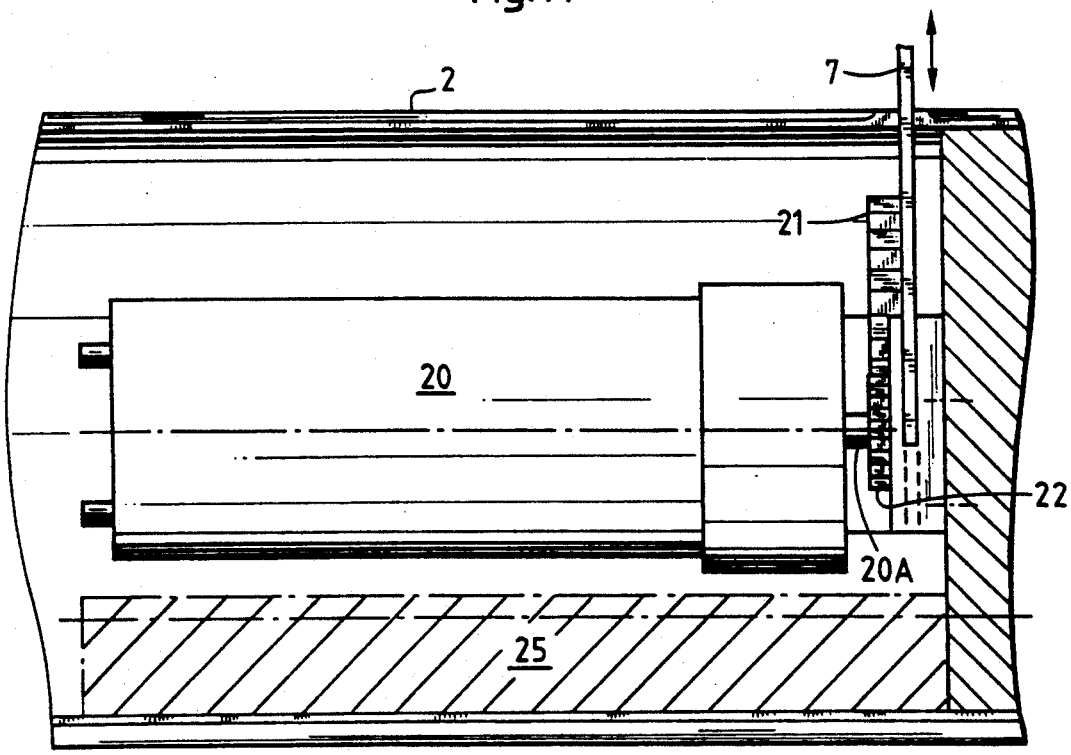

Two arrangements are feasible for the electric motor:

a transverse arrangement (FIGS. 12 and 13), an axial arrangement (FIGS. 14 and 15).

In the transverse arrangement the axis of the motor 10 is transverse to the missile axis, movement being imparted to the spoiler 7 from the motor by a recirculating ball screw 11. Gears 12 and 13 couple the shaft 10A of the motor and the screw 11. A screw bearing 14 is fixed to the spoiler. Spoiler guides 15 and 16 and a displacement sensor 17 are also provided.

In the axial arrangement the axis of the motor 20 is along the axis of the missile. The motion is transmitted by a rack 21 fixed to the spoiler and meshing with a pinion 22 fixed to the shaft 20A of the motor. Spoiler guides tabs 23 and 24 and an electrical power supply unit 25 are also provided.

In both cases the volumes occupied by and the masses of the hardware used are substantially the same. For each solution proportional control is employed, using a displacement sensor (shown in FIG. 12 only).

Figure 16:
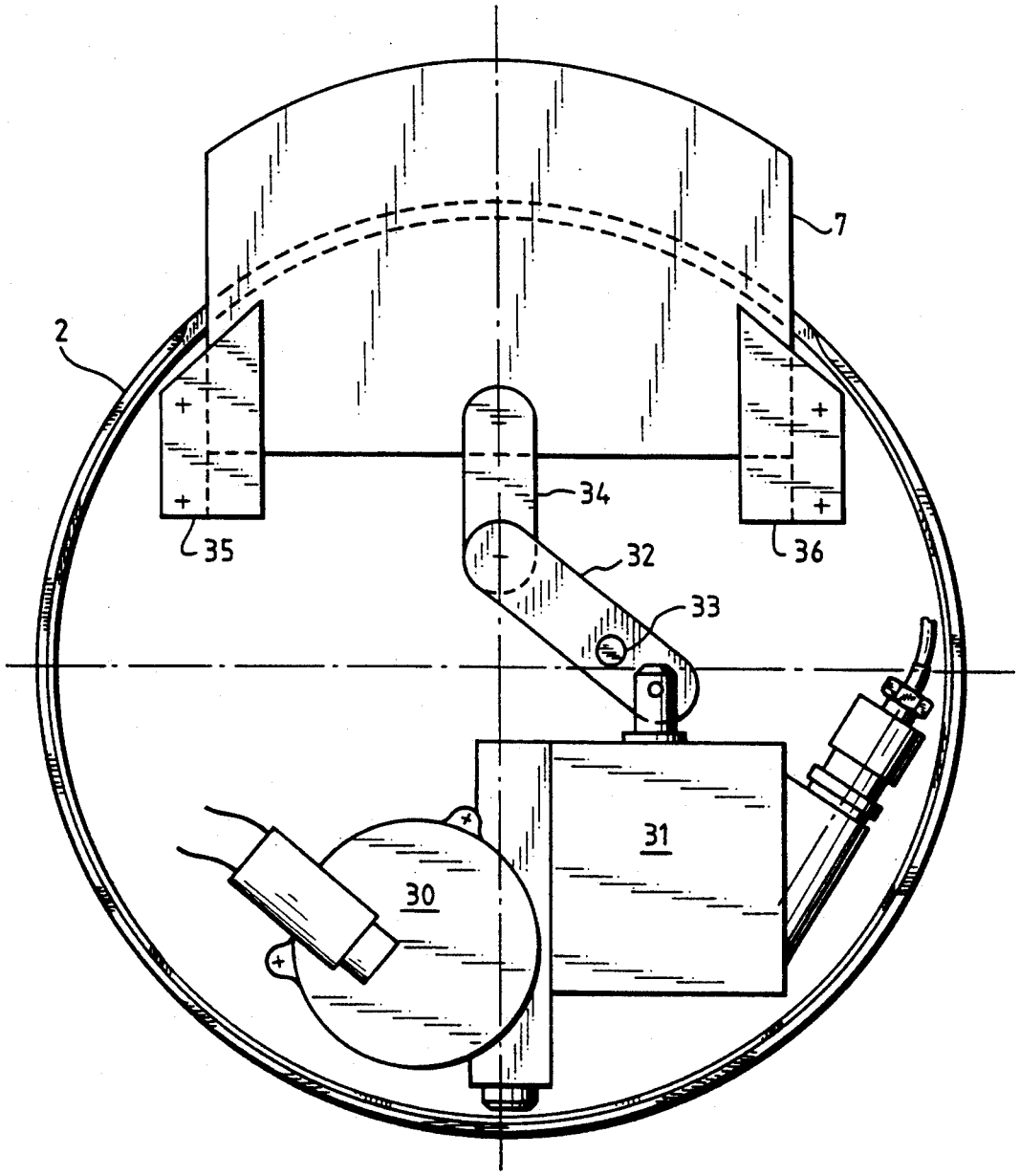
FIG. 16 is a view in transverse cross-section of a missile fitted with a third embodiment of torque control device.

Pneumatic control may be used: FIG. 16 shows an electric motor driving a pneumatic actuator 31 operating on a lever 32 with a fixed pivot 33. This lever operates on a linkage 34 coupled to the spoiler which is guided by guides 35 and 36.

The control system may be supplied with hot gas or with cold gas (using an onboard gas cylinder). The forces and the response times of the envisaged solutions are compatible with the required performance.

For both envisaged solutions a comparative balance of overall dimensions and masses is as follows:

the conventional solution (that is to say with aerodynamic controls, actuators and their power supply, etc) represents a weight balance of 6 kg, for the electrical solution, the overall size depends on which location is adopted but:

the weight of the spoiler is 0.2 kg, the weight of the motor and the connecting cables is 1 kg, the weight of the batteries is 1.2 kg, the weight of the various mechanical parts (guides, fixings, drive) is 0.7 kg, the weight of the electronics is 0.4 kg, that is a total weight of 3.5 kg;

for the pneumatic solution the overall size excluding the generator is 0.5 caliber:

the weight of the spoiler is 0.2 kg, the weight of the gas generator is 1 kg, the weight of the various mechanical parts is 0.5 kg, the weight of the actuators, drive motor and control system is 1.3 kg, that is a total weight of 3 kg.

The conventional solution therefore has a weight balance which is approximately twice the balance for both the solutions proposed by the invention.

It goes without saying that the foregoing description has been given by way of non-limiting example only, in particular with reference to the various dimensions and masses, and that numerous variants may be proposed by those skilled in the art without departing from the scope of the invention.

The above description applies generally to applications with one or more spin or otherwise stabilized roll control channels.

For example, in the case of a missile roll stabilized by aerodynamic controls, separate controls may provided for pitch and yaw: the missile can have pitch and yaw controls using four nose-mounted spoilers.

If the missile is spinning on its axis, a single spoiler control function may be sufficient (see above), but a system with two independent spoilers could be advantageous, the first spoiler operating over one-half evolution and the second spoiler over the next half-revolution, and so on. This makes it possible to give two commands per rotation (rather than a single command), these commands being identical or different ("intelligent"). The maneuvrability is therefore doubled on average.

The possibility of combining nose-mounted and aft spoilers is also feasible, as is the combination of spoiler control at the front and jet control aft or vice versa.

Separate control systems for the two control units are also feasible.

Figure 17:
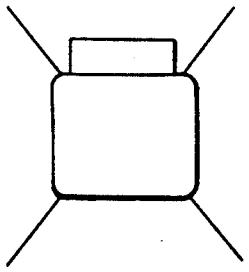
FIG. 17 is an end-on view of another missile according to the invention, having a fuselage of square cross-section.
Figure 18:
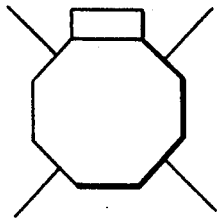
FIG. 18 is an end-on view of another missile according to the invention having a fuselage of octagonal cross-section.
Figure 19:
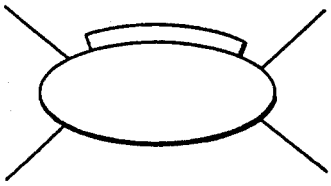
FIG. 19 is an end-on view of another missile according to the invention having a fuselage of elliptical cross-section.
Figure 20:
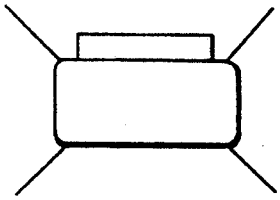
FIG. 20 is an end-on view of another missile according to the invention having a fuselage of rectangular cross-section.
Figure 21:
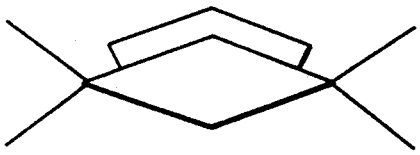
FIG. 21 is an end-on view of another missile according to the invention having a losenge-shaped fuselage.

Note that the invention is not limited to cylindrical fuselages, but applies equally to fuselages of polygonal cross-section inscribed in a circle (square FIG. 17 octagon FIG. 18, etc) or even of substantially elliptical crosssection FIG. 19, especially if inscribed within an ellipse (rectangle FIG. 20, losenge FIG. 21, etc). The concept of "diameter" previously refered to then denotes an average transverse dimension.

There is claimed:

1. Supersonic guided missile comprising a fuselage terminating in a front nose and in a rear base and provided externally with fixed aft planes and a torque inducing device comprising at a longitudinal distance from the center of gravity of said missile, at least one spoiler transversely mobile between a configuration retracted inside said fuselage and an active deployed configuration in which said spoiler projects laterally from said fuselage.

2. Missile according to claim 1 wherein said spoiler is a substantially planar transverse spoiler which remains at all times in a transverse plane when in and between said retracted and active configuration.

3. Missile according to claim 1 wherein said spoiler is nose-mounted.

4. Missile according to claim 3 wherein said fuselage further comprises foreplanes.

5. Missile according to claim 3 wherein said spoiler is at a distance from said nose of said missile between 10% and 30% of the length of said fuselage.

6. Missile according to claim 3, wherein said fuselage has foreplanes, the aft surface of said spoiler is transversely aligned with the trailing edge of said foreplanes.

7. Missile according to claim 1 wherein said spoiler is aft-mounted between two of said aft planes.

8. Missile according to claim 7 wherein said spoiler is at a distance from said nose of said missile between 90% and 100% of the length of said fuselage.

9. Missile according to claim 7 wherein the aft surface of said spoiler is transversely aligned with the trailing edge of said aft planes.

10. Missile according to claim 7 wherein said fuselage further comprises foreplanes.

11. Missile according to claim 1 wherein said nose of said fuselage is ogive-shape with an aspect ratio between two and four.

12. Missile according to claim 1 wherein said spoiler is deployed radially to a distance less than 20% of the average transverse dimension of said fuselage.

13. Missile according to claim 12 wherein said spoiler is deployed to approximately 10 to 20% of said average transverse dimension.

14. Missile according to claim 13 wherein said spoiler is deployed to approximately 15% of said average transverse dimension.

15. Missile according to claim 1 wherein said spoiler is deployed to a distance less than 20% of the length of said fuselage.

16. Missile according to claim 15 wherein said spoiler is deployed to a distance equal to approximately 1 to 2% of the length of said fuselage.

17. Missile according to claim 1 wherein said spoiler intersects said fuselage at an angle of approximately 90°.

18. Missile according to claim 1 wherein said spoiler is actuated by an electrically controlled actuator.

19. Missile according to claim 18 wherein the spoiler actuator comprises a motor with a shaft disposed transversely to the longitudinal axis of said missile.

20. Missile according to claim 18 wherein the spoiler actuator comprises a motor with a shaft disposed parallel to the longitudinal axis of said missile.

21. Missile according to claim 1 wherein said spoiler is actuated by a pneumatically controlled actuator.

22. Missile according to claim 1 wherein said spoiler is actuated by a proportional control actuator.

23. Missile according to claim 1 wherein said spoiler is mounted on a locally flat portion of said fuselage.

24. Missile according to claim 1 wherein said fuselage has a substantially cylindrical cross-section.

25. Missile according to claim 1 wherein said fuselage has a polygonal cross-section.

26. Missile according to claim 1 wherein said fuselage has a substantially elliptical cross-section.

27. Missile according to claim 1 wherein said spoiler is a planar transverse spoiler.

28. Missile according to claim 1 wherein said spoiler is controlled by a specific actuator.

29. Supersonic guided missile comprising a fuselage terminating at one end in a front nose and, at another end, in a rear base and provided externally with fixed aft planes, and torque inducing device comprising at least one spoiler located near one of said ends and transversely mobile between a configuration retracted inside said fuselage and an active deployed configuration in which said spoiler projects laterally from said fuselage.

30. Supersonic guided missile comprising a fuselage terminating at one end in a front nose and, at another end, in a rear base and provided externally with fixed aft planes, and a torque control device comprising a single spoiler transversely mobile between a configuration retracted inside said fuselage and an active deployed configuration in which said spoiler projects laterally from said fuselage.

* * * * *